US007581970B2

(12) United States Patent
Englund

(10) Patent No.: US 7,581,970 B2
(45) Date of Patent: Sep. 1, 2009

(54) MULTIPURPOSE UNIVERSAL SERIAL BUS CABLE

(75) Inventor: Hakan M. Englund, Haninge (SE)

(73) Assignee: Sony Ericsson Mobile Communications AB, Nya Vattentornet (SE)

( * ) Notice: Subject to any disclaimer, the term of this patent is extended or adjusted under 35 U.S.C. 154(b) by 0 days.

(21) Appl. No.: 11/950,624

(22) Filed: Dec. 5, 2007

(65) Prior Publication Data

US 2009/0130874 A1 May 21, 2009

Related U.S. Application Data

(60) Provisional application No. 60/988,551, filed on Nov. 16, 2007.

(51) Int. Cl.
*H01R 29/00* (2006.01)

(52) U.S. Cl. ..... 439/171

(58) Field of Classification Search ..... 439/660, 439/131, 171, 170, 52, 640, 638
See application file for complete search history.

(56) References Cited

U.S. PATENT DOCUMENTS 7,247,038 B2 * 7/2007 Smadi et al. ..... 439/181

FOREIGN PATENT DOCUMENTS

WO 2007/108570 9/2007

OTHER PUBLICATIONS

International Search Report and Written Opinion for International Application No. PCT/IB2008/001228 dated Sep. 8, 2008.

* cited by examiner

*Primary Examiner*—Javaid Nasri
(74) *Attorney, Agent, or Firm*—Renner, Otto, Boisselle & Sklar, LLP

(57) ABSTRACT

A cable, connector and keying system that support conventional Universal Serial Bus (USB) signals on a first end and a second connector associated with the cable and system is operative in at least two mechanical positions. Based upon the selected mechanical position, the cable is configured to allow certain functions and/or prohibit certain functions. For example, when the connector is in a first position, it may desirable to connect an accessory device to the mobile telephone through the cable. However, when the connector is in a second position, it may be desirable to prevent the user from connecting the accessory device to the mobile telephone because, for example, when the cable is operating in the configured mode damage may occur to the accessory device.

17 Claims, 8 Drawing Sheets

MULTIPURPOSE UNIVERSAL SERIAL BUS CABLE

RELATED APPLICATION DATA

This application claims the benefit of U.S. Provisional Application No. 60/988,551, filed Nov. 16, 2007, which is incorporated by reference.

TECHNICAL FIELD OF THE INVENTION

The present invention relates to electrical connectors and, more particularly to, Universal Serial Bus (USB) connectors having more than one operative mechanical position configured by an associated user to perform electrical operations based on the mechanical position of the connector.

DESCRIPTION OF THE RELATED ART

Today it is commonplace for electronic equipment, such as, for example, communication devices, mobile phones, personal digital assistants, personal computers, digital video recorders, digital camcorders, digital cameras, computer peripheral devices, etc. to include a Universal Serial Bus (USB). USB is a serial bus standard to interface devices through a standardized interface port to improve plug-and-play capabilities by allowing devices to be connected and disconnected without rebooting the computer. Other convenient features associated with USB include powering low-consumption devices without the need for an external power supply and allowing some devices to be used without requiring individual device drivers to be installed.

The implementation of USB is generally in the form of male and female USB connectors, which are commonly employed in electronic equipment. A conventional USB female connector includes four or five signal contacts depending on the type of USB connector. The signals generally provided on a conventional USB connector include VBUS (+5 Volts), Ground (GND), Data−(D−) and Data+ (D+). If a fifth identification (ID) signal is provided on the USB connector, the signal contact may be used by an attached device to indicate presence and/or identification of another device. In some embodiments, the ID signal is used for on-the-go (OTG) functionality, which can make a slave device function as a host. In other embodiments, the fifth connector may not be connected or held at ground depending on the requirements of the specific device. Female USB connectors are typically electrically connected to a motherboard. The signal contacts of the female connector engage with the male connector, thereby transmitting signals through the cable and the mother board for communication between the motherboard and the peripheral device.

While USB is substantially uniform, mobile telephone manufacturers generally use chargers that are standardized for different telephone models selling in different countries. In an effort to reduce the number of power adapters that become redundant due to the upgrade of equipment and thereby reduce the impact of the abandoned electronic parts on the environment and the waste of natural resources, at least one country (e.g., China) is requiring all mobile telephone handsets to provide a USB interface for battery charging and data transmission purposes.

In such situation, the battery charger is no longer equipped with a special connector having different power characteristics customized to each mobile phone manufacturer. Instead, chargers are equipped with a standard USB Type A receptacle and the output power is regulated to ensure that it can be used across all new handsets. With this USB interface in place, handsets can be recharged by universal chargers and mobile telephones phone can also be recharged by other USB hosts such as a personal computer. This is much more convenient for users, since only a single cable is needed for both power and data exchange.

One problem with this requirement is that many manufacturers of mobile telephones have proprietary connectors that are used to connect the mobile telephone between a computer and/or a charger. Accordingly, manufacturers would be required to incur substantial costs to uniformly change all mobile telephones to comply with the requirement for a single country. In addition, increased costs would also be incurred in another country adopted another standard.

Referring to FIG. 1, an exemplary charger 10 is illustrated. The charger 10 may receive an input from a source 12 (e.g., a direct current source and/or an alternating current source). The charger 10 outputs the current from the charger between the VBUS and GND signals, as shown in FIG. 1. The two data lines D+ and D− signals are shorted together (in a proposed update of the USB specification the maximum resistance between D+ and D− is specified to 200 ohm). This requirement is currently being implemented in China, as such it will be referred to as the "China Charger" requirement.

There are currently two solutions to comply with the China Charger requirement. First, a manufacturer may deliver the telephone to the Chinese user with two USB-cables, one for regular USB use and one identified herein as a "Gimli" for charging the mobile device in accordance with the China Charger requirement. Typical connections for the two different cables are shown in FIGS. 2A and 2B. Referring to FIG. 2A, the signals from the host 20 are output to a conventional USB cable 24 for use by a mobile telephone 22 in a conventional manner. That is, the VBUS, D+, D− and GND signals are received by the mobile telephone 22 at corresponding signal connectors for use in a conventional manner.

Referring to FIG. 2B, the cable 26 coupled between the charger 10 and the mobile telephone 22 is configured to have two signal paths, VBUS and D+ shorted together. Since the D+ and D− pins of the charger 10 are also coupled together, the output from the cable 26 effectively couples the VBUS and GND signals from the charger 10 to the direct current input/output (DCIO) and GND signals, respectively, of the mobile telephone 22 for charging the mobile telephone. In this example, the cable does not route VBUS directly to DCIO because this would violate the USB standard because the mobile telephone would be drawing current without enumeration first. In this example, the mobile telephone side of cable 26 is supplying current to the mobile telephone 22 in a conventional manner. Therefore, the mobile telephone sees a regular charger. One drawback with this solution is the added cost of the USB charging cable and also the almost certain confusion and/or irritation from the customer. For example, the customer will wonder why there are two cable, uncertainty as to when to use which cable, and a need to carry two cables. Another drawback with the use of cable 26 is the fact that charging might not work at all if the resistance between D+ and D− in the China Charger is more than 0 ohm.

Another solution is provided in FIG. 3. FIG. 3 illustrates charger 10 coupled by a conventional USB cable 24 to a mobile telephone 28. The mobile telephone 28 includes a smart switch 30, which detects whether the data lines D+ and D− are shorted. If D+ and D− are shorted, then the mobile telephone 28 is connected to charger 10 and VBUS signal is routed to the DCIO input of the mobile telephone 28. If D+ and D− are not detected as being shorted, then the mobile telephone 28 is connected to device as if a conventional USB connector was present. One disadvantage with the smart switch solution and the use of one single USB cable is that when using a desk stand (also known as a cradle), it is not possible to send/receive USB data and give the phone an optimized (high current) charge at the same time. Another similar drawback is that it is not possible to stack a USB connector on top of a charger connector (to obtain simultaneous optimized charging and USB data exchange) since no charging cable is provided with the mobile telephone.

Another disadvantage with smart switch solution is the fact that it is not obvious for the user as to where he or she should connect the regular USB cable in a desk stand (or cradle), which has two or more possible connectors for the cable. As shown in FIG. 4A, a desk stand 40 may include multiple ports 42, 44 and may be coupled to a personal computer 46 through a conventional USB cable 48. It is generally undesirable for data connector input 42 of the desk stand 40 to be used in connection with a power adapter 50 (e.g., China Charger), as shown in FIG. 4B. This means that the user must switch between the personal computer and the charger when using desk stand. Referring to FIG. 4A, a desk stand 40 is illustrated coupled to a personal computer 46 through data port 42. In such an implementation, USB data may be exchanged along with low current charging.

SUMMARY

In view of the aforementioned shortcomings associated with charging and exchanging communications with mobile telephones, there is a need in the art for a universal connector that electrically and mechanically can switch between conventional USB (data/low current charging) and charging (high current charging).

One aspect of the invention relates to a universal system connector cable including: a first connector having a plurality of first signal contacts housed at least partially therein; a second connector including: an adjustable housing operable in a first position and a second position, a plurality of second signal contacts housed at least partially within the adjustable housing; and circuitry housed within the adjustable housing, wherein when the housing is in the first position, the plurality of second signal contacts are configured to operate in a first mode and when the adjustable housing is in the second position, the plurality of second signal contacts are configured to operate in a second mode; and a cable connected to the first connector and the second connector.

Another aspect of the invention relates to the first connector being a universal serial bus (USB) connector.

Another aspect of the invention relates to the plurality of first contacts including a contact for a data+signal contact, a data−signal contact, a ground signal contact and VBUS signal contact.

Another aspect of the invention relates to when the adjustable housing is in the first position, the plurality of second signal contacts are configured to output corresponding data+ signal contact, the data−signal contact, the ground signal contact and the VBUS signal contact.

Another aspect of the invention relates to when the adjustable housing is in the first position, the first contacts and the second contacts are configured to exchange information between associated electronic devices coupled to the cable in the first mode.

Another aspect of the invention relates to the first mode includes charging the electronic device coupled to the second connector from a power source associated with the electronic device coupled to the first connector.

Another aspect of the invention relates to when the adjustable housing is in the second position, the plurality of second signal contacts are configured to output the ground signal and a high current signal to an associated electronic device coupled to the second connector for operation in the second mode.

Another aspect of the invention relates to the second mode including charging the electronic device at a faster rate than possible in the first mode.

Another aspect of the invention relates to the cable being coupled to the second connector on a face opposing a surface of the second connector that engages the associated electronic device.

Another aspect of the invention relates to the cable cooperates with the adjustable housing to prevent stacking of one or more connectors to the adjustable housing when the adjustable housing is in the first position.

Another aspect of the invention relates to the cable cooperating in conjunction with the adjustable housing to allow stacking of a non-charger connector to the adjustable housing when the adjustable housing is in the second position.

Another aspect of the invention relates to the circuitry including a P-type field effect transistor and a N-type field effect transistor, wherein in the second position, the P-type field effect transistor is operative to provide a fast charging current to the associated electronic device.

Another aspect of the invention relates to the D+ and D− signal contacts are electrically pulled up to the VBUS signal when the adjustable housing is in the second position and a China Charger is attached.

Another aspect of the invention relates to in the first position, the P-type field effect transistor and the N-type field effect transistor are in an off state.

One aspect of the invention relates to a universal system connector including: an adjustable housing operable in a first position and a second position; at least one engagement structure coupled to the housing for securing the housing to an associated electronic device; a plurality of signal contacts housed at least partially within the adjustable housing; circuitry housed within the adjustable housing, wherein when the housing is in the first position, the plurality of signal contacts are configured to operate in a first mode and when the adjustable housing is in the second position, the plurality of signal contacts are configured to operate in a second mode.

Another aspect of the invention relates to the adjustable housing being slidably configured between the first position and the second position.

Another aspect of the invention relates to the adjustable housing having a larger area in the second position than in the first position.

Another aspect of the invention relates to a cable secured to the universal system connector on a face opposing a signal contact interface.

One aspect of the invention relates to a cable keying system, the system including: a cable having a first connector for coupling to a first electronic equipment and a second connector for coupling to a second electronic equipment to facilitate an exchange of signals between the first electronic equipment and the second electronic equipment, wherein the first connector is operable in a first position to perform a first electronic function and the first connector is operable in a second position to perform a separate electronic function, wherein the position of the connector allows one or more connectors to be coupled to the first connector and prevents at least one predetermined other cable from coupling to the first connector based at least in part on the position of the connector.

To the accomplishment of the foregoing and the related ends, the invention, then, comprises the features hereinafter filly described in the specification and particularly pointed out in the claims, the following description and the annexed drawings setting forth in detail certain illustrative embodiments of the invention, these being indicative, however, of but several of the various ways in which the principles of the invention may be suitably employed.

Other systems, methods, features, and advantages of the invention will be or become apparent to one with skill in the art upon examination of the following drawings and detailed description. It is intended that all such additional systems, methods, features, and advantages be included within this description, be within the scope of the present invention and be protected by the accompanying claims.

Although the invention is shown and described with respect to one or more embodiments, it is to be understood that equivalents and modifications will occur to others skilled in the art upon the reading and understanding of the specification. The present invention includes all such equivalents and modifications, and is limited only by the scope of the claims.

Also, although the various features are described and are illustrated in respective drawings/embodiments, it will be appreciated that features of a given drawing or embodiment may be used in one or more other drawings or embodiments of the invention.

It should be emphasized that the term "comprise/comprising" when used in this specification is taken to specify the presence of stated features, integers, steps or components but does not preclude the presence or addition of one or more other features, integers, steps, components or groups thereof."

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views.

DETAILED DESCRIPTION OF EMBODIMENTS

Figure 1:
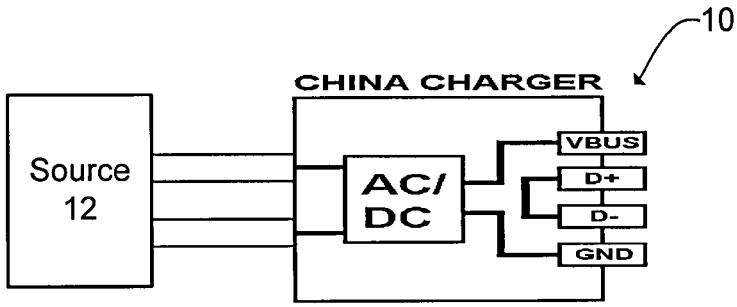
Figure 1 (Prior Art)
FIG. 1 is a prior art China Charger.
Figure 2A:
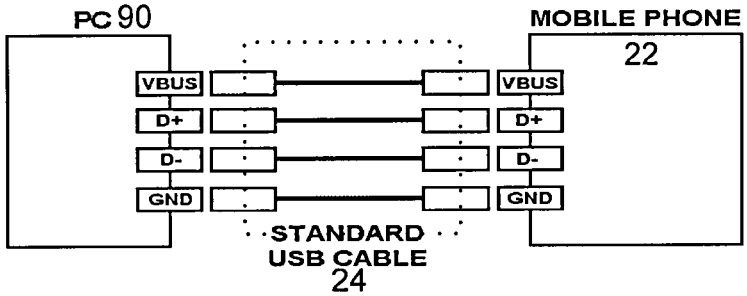
Figure 2A (Prior Art)
FIGS. 2A is a prior art system for coupling a personal computer to a mobile telephone.
Figure 2B:
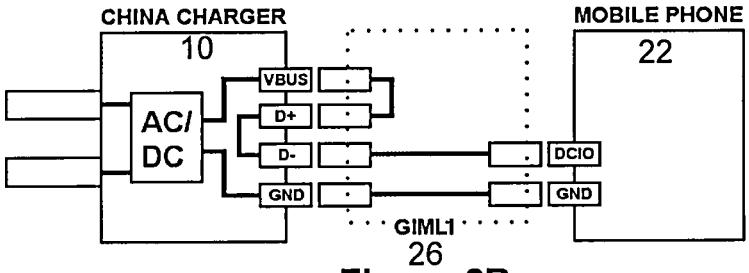
Figure 2B (Prior Art)
FIG. 2B is a prior art system for coupling China Charger to a mobile telephone.
Figure 3:
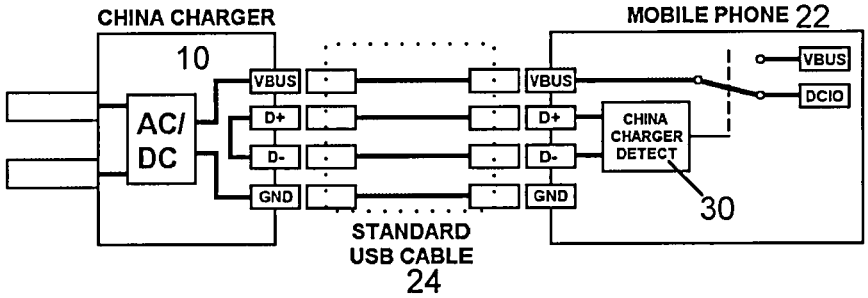
Figure 3 (Prior Art)
FIG. 3 is a prior art system for coupling a China Charger to a mobile telephone.
Figure 4A:
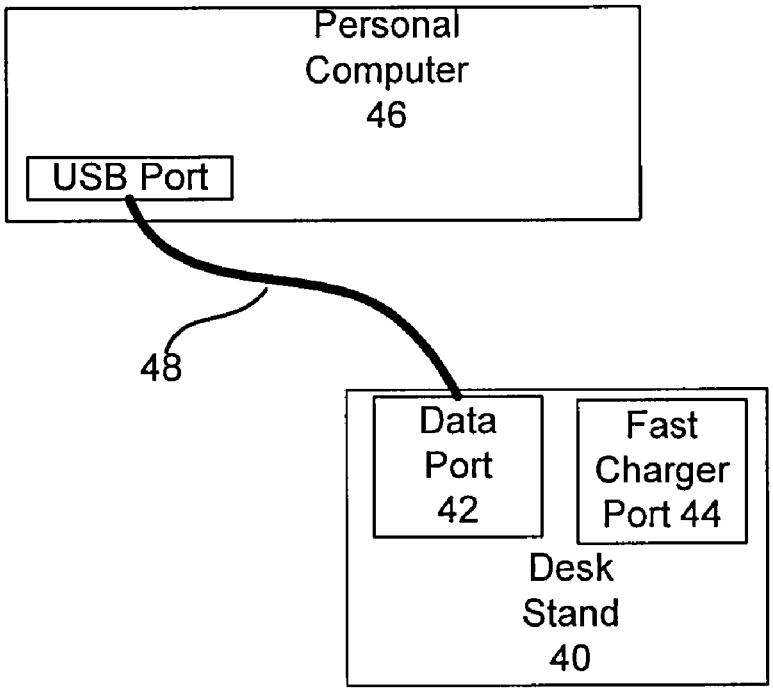
Figure 4A (Prior Art)
FIG. 4A is a prior art systems for coupling a mobile telephone to computer.
Figure 4B:
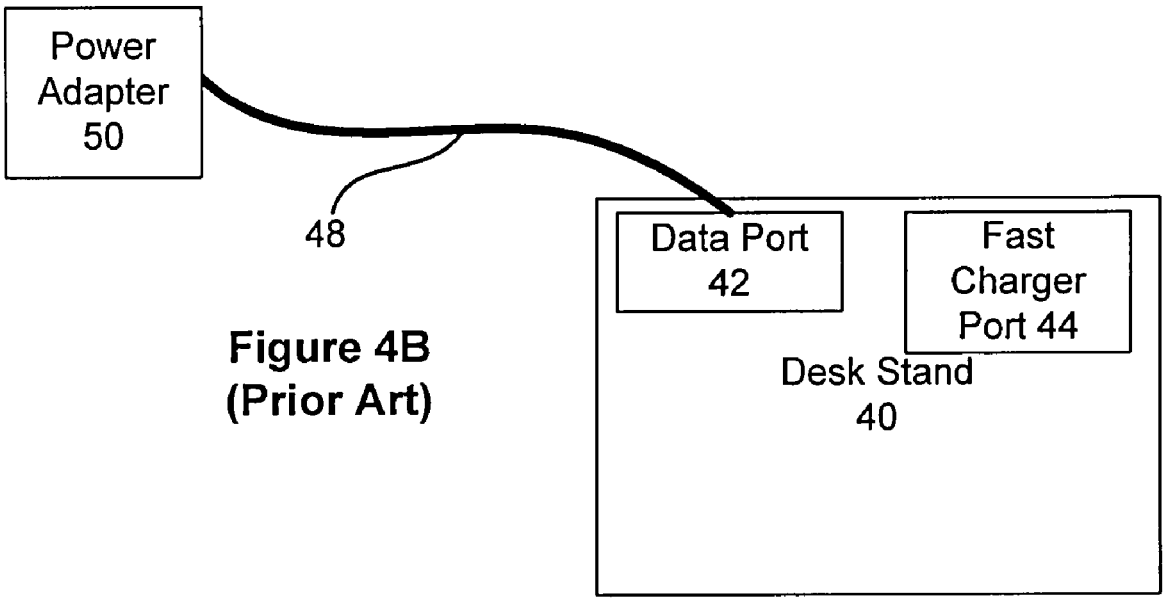
Figure 4B (Prior Art)
FIG. 4B is a prior art system for coupling a mobile telephone to a China Charger.

Universal Serial Bus (USB) connectors are suitable for use in a wide variety of electronic equipment (e.g., communication devices, mobile telephones, personal digital assistants, personal computers, digital video recorders, digital camcorders, digital cameras, computer peripheral devices, etc.). Embodiments of the present invention will now be described with reference to the drawings, wherein like reference numerals are used to refer to like elements throughout. It will be understood that the figures are not necessarily to scale.

The interchangeable terms "electronic equipment" and "electronic device" include portable radio communication equipment, personal computers, digital video recorders, digital camcorders, digital cameras, computer peripheral devices, etc.). The term "portable radio communication equipment," which hereinafter is referred to as a "mobile radio terminal," includes all equipment such as mobile telephones, pagers, communicators, electronic organizers, personal digital assistants (PDAs), smart phones, portable communication apparatus, portable gaming devices, portable media devices (video and/or audio), and the like.

In the present application, embodiments of the invention are described primarily in the context of a mobile telephone. However, it will be appreciated that the invention is not intended to be limited to the context of a mobile telephone and may relate to any type of electronic equipment.

Aspects of the present invention are directed to a universal system connector that the user mechanically and electrically can switch cable behavior between a conventional universal serial bus (USB), which allows data exchange and low current charging of an electronic device and the China Charger requirement, which permits high current charging. As such, a single cable is utilized to for two modes of operation and the risk that the user packs the wrong cable is now removed.

With respect to the mechanical solution, the user simply slides a switch to select USB data cable mode or charger cable mode. This results in a mechanical change on the system connector side of the universal cable. The mechanical keying of the system connector side of the cable changes when switched between the first mode (e.g., USB data mode) and the second mode (e.g., high current charging mode) and vice versa. The sliding of the switch means an electrical connection of wires in the system connector interface is changed between the first mode and the second mode as explained below.

Figure 5:
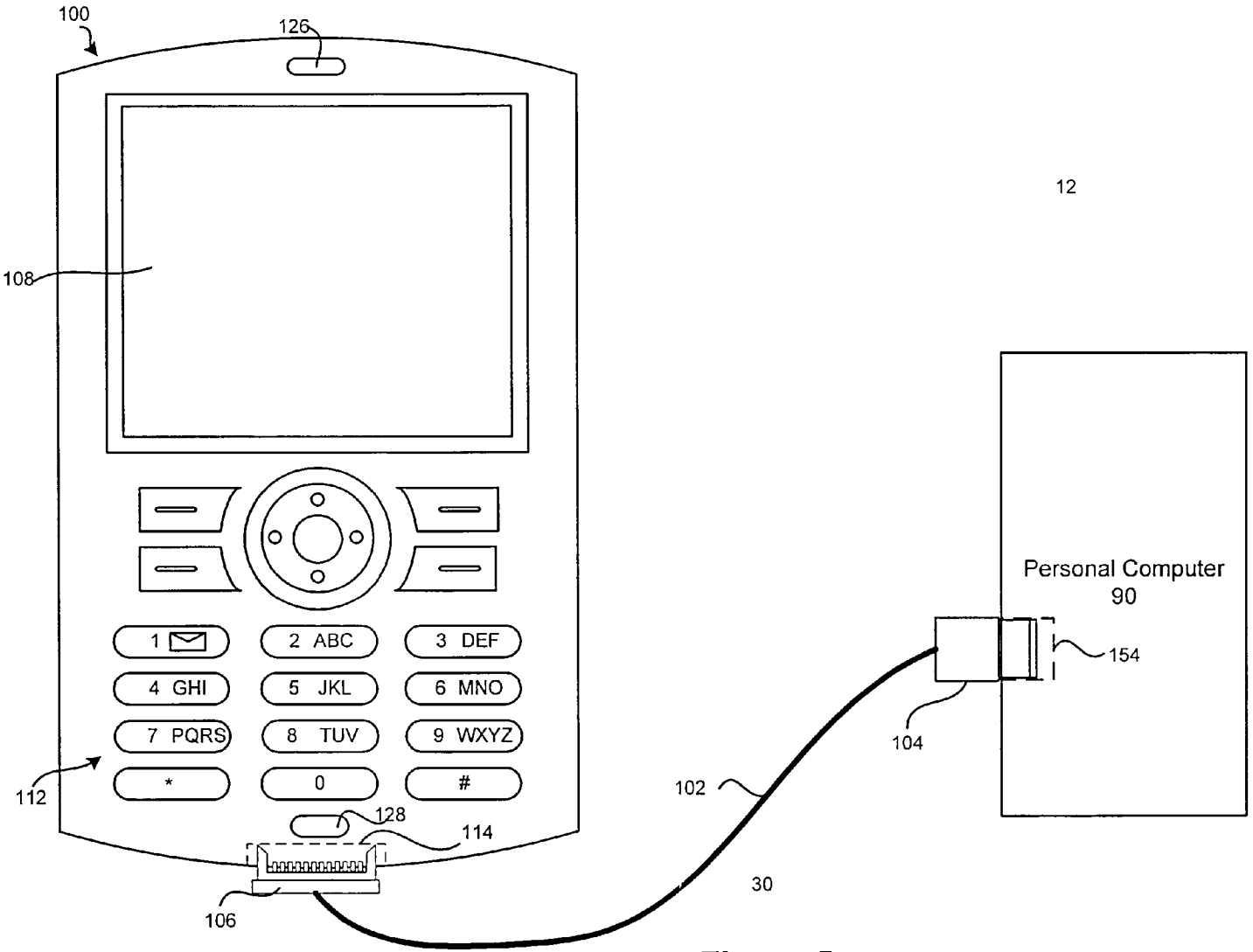
FIG. 5 is an exemplary system in accordance with aspects of the present invention.

Referring to FIG. 5, an exemplary system in accordance with aspects of the present invention is illustrated. The system includes a personal computer 90 coupled to an electronic device 100 through a cable 102. The cable 102 has a first connector 104 for connecting to the personal computer 90 and a second connector 106 for connecting to the electronic device 100. The electronic device 100 of the illustrated embodiment is a mobile telephone and will be referred to as the mobile telephone 100. The mobile telephone 100 is shown as having a brick or block form factor, although other form factors, such as a "flip-open" form factor (e.g., a "clamshell" housing) or a slide-type form factor (e.g., a "slider" housing) also my be utilized.

The mobile telephone 100 may include a display 108. The display 108 displays information to a user such as operating state, time, telephone numbers, contact information, various navigational menus, etc., which enable the user to utilize the various features of the mobile telephone 100. The display 108 also may be used to visually display content received by the mobile telephone 100 and/or retrieved from a memory 110 (FIG. 6) of the mobile telephone 100. The display 108 may be used to present images, video and other graphics to the user, such as photographs, mobile television content and video associated with games.

A keypad 112 provides for a variety of user input operations. For example, the keypad 112 typically includes alphanumeric keys for allowing entry of alphanumeric information such as telephone numbers, phone lists, contact information, notes, etc. In addition, the keypad 112 typically includes special function keys such as a "call send" key for initiating or answering a call, and a "call end" key for ending or "hanging up" a call. Special function keys also may include menu navigation and select keys to facilitate navigating through a menu displayed on the display 108. For instance, a pointing device and/or navigation keys may be present to accept directional inputs from a user. Special function keys may include audiovisual content playback keys to start, stop and pause playback, skip or repeat tracks, and so forth. Other keys associated with the mobile telephone 100 may include a volume key, an audio mute key, an on/off power key, a web browser launch key, a camera key, etc. Keys or key-like functionality also may be embodied as a touch screen associated with the display 108. Also, the display 108 and keypad 112 may be used in conjunction with one another to implement soft key functionality.

The mobile telephone 100 includes call circuitry that enables the mobile telephone 100 to establish a call and/or exchange signals with a called/calling device, typically another mobile telephone or landline telephone. However, the called/calling device need not be another telephone, but may be some other device such as an Internet web server, content providing server, etc. Calls may take any suitable form. For example, the call could be a conventional call that is established over a cellular circuit-switched network or a voice over Internet Protocol (VoIP) call that is established over a packet-switched capability of a cellular network or over an alternative packet-switched network, such as WiFi (e.g., a network based on the IEEE 802.11 standard), WiMax (e.g., a network based on the IEEE 802.16 standard), etc.

The mobile telephone 100 may be configured to transmit, receive and/or process data, such as text messages (e.g., a text message is commonly referred to by some as "an SMS," which stands for short message service), instant messages, electronic mail messages, multimedia messages (e.g., a multimedia message is commonly referred to by some as "an MMS," which stands for multimedia message service), image files, video files, audio files, ring tones, streaming audio, streaming video, data feeds (including podcasts) and so forth. Processing such data may include storing the data in the memory 110, executing applications to allow user interaction with data, displaying video and/or image content associated with the data, outputting audio sounds associated with the data and so forth.

The personal computer 90 illustrated in FIG. 5 may be any type of computer utilizing any suitable operating system. For example, the personal computer 90 may be a desktop computer, a laptop computer, a windows-based computer, a Mac-Based computer, a Linux-based computer, etc. Generally, the personal computer 90 is capable of transmitting data to the mobile telephone 100 and/or receiving data from the mobile telephone 100. In addition, the personal computer 90 is capable of charging the mobile telephone 100 through the USB connection. One drawback with charging the mobile telephone 100 through the USB connection is that based on the USB specification, output power is limited to 500 mA, which may require a substantial amount of time for the mobile telephone 100 to be connected to the personal computer 90 to be fully charged.

As shown in FIG. 5, cable 102 is generally provided to couple the personal computer 90 to the mobile telephone 100. As explained below, the cable 102 includes a first electrical connector 104 that matingly engages with electrical connector of the personal computer 90 (e.g., through a USB port). The cable 102 further includes a second electrical connector 106 that matingly engages with the electrical connector 114 of the mobile telephone 100 to accomplish the functionality described herein.

Figure 6:
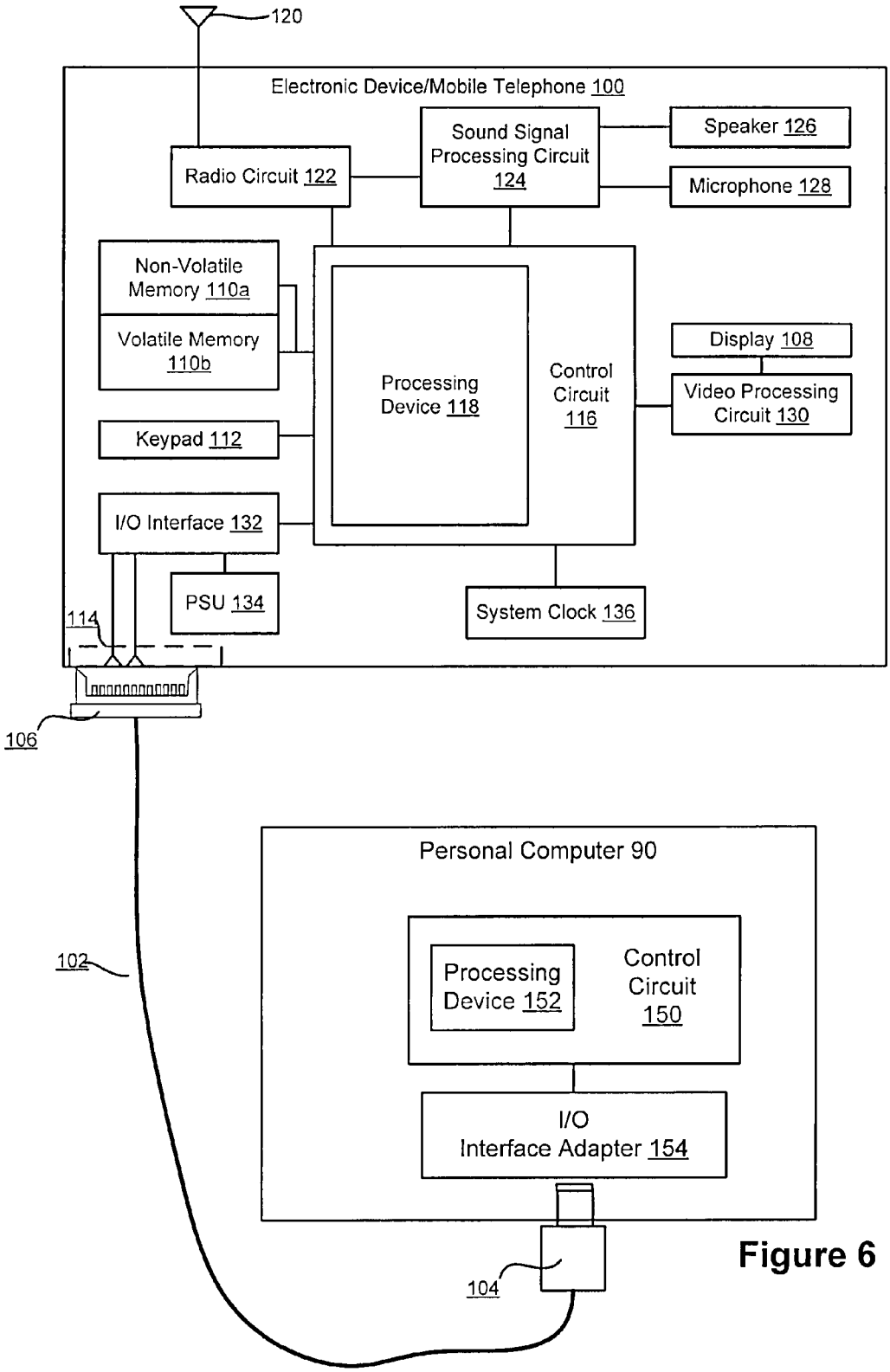
FIG. 6 is a functional block diagram of the exemplary system illustrated in FIG. 5.

FIG. 6 represents a functional block diagram of the mobile telephone 100 and the personal computer 90. For the sake of brevity, generally conventional features of the mobile telephone 100 and the personal computer 90 will not be described in great detail herein. The mobile telephone 100 includes a primary control circuit 116 that is configured to carry out overall control of the functions and operations of the mobile telephone 100. The control circuit 116 may include a processing device 118, such as a CPU, microcontroller or microprocessor. The processing device 118 executes code stored in a memory (not shown) within the control circuit 116 and/or in a separate memory, such as the memory 110, in order to carry out operation of the mobile telephone 100.

The memory 110 may include a read only memory area that is implemented using nonvolatile memory 110*a*, and a random access or system memory area that is implemented using volatile memory 110*b*. As will be appreciated, nonvolatile memory tends not to lose data storage capability upon loss of power and is typically used to store data, application code, files and so forth. The nonvolatile memory 110*a* may be implemented with a flash memory, for example. As will be appreciated, volatile memory tends to lose data storage capability upon loss of power and is typically used to store data for access by the processing device 118 during the execution of logical routines. The volatile memory 110*b* may be a random access memory (RAM). Data may be exchanged between the nonvolatile memory 110*a* and the volatile memory 110*b* as is conventional. The nonvolatile memory 110*a* and the volatile memory 110*b* may be sized as is appropriate for the mobile telephone 100 or other electronic device in which the memory 110 is used.

Continuing to refer to FIGS. 5 and 6, the mobile telephone 100 includes an antenna 120 coupled to a radio circuit 122. The radio circuit 122 includes a radio frequency transmitter and receiver for transmitting and receiving signals via the antenna 120 as is conventional. The radio circuit 122 may be configured to operate in a mobile communications system and may be used to send and receive data and/or audiovisual content. Receiver types for interaction with a mobile radio network and/or broadcasting network include, but are not limited to, GSM, CDMA, WCDMA, GPRS, WiFi, WiMax, DVB-H, ISDB-T, etc., as well as advanced versions of these standards.

The mobile telephone 100 further includes a sound signal processing circuit 124 for processing audio signals transmitted by and received from the radio circuit 122. Coupled to the sound processing circuit 124 are a speaker 126 and a microphone 128 that enable a user to listen and speak via the mobile telephone 100 as is conventional. The radio circuit 122 and sound processing circuit 124 are each coupled to the control circuit 116 so as to carry out overall operation. Audio data may be passed from the control circuit 116 to the sound signal processing circuit 124 for playback to the user. The audio data may include, for example, audio data from an audio file stored by the memory 110 and retrieved by the control circuit 116, or received audio data such as in the form of streaming audio data from a mobile radio service. The sound processing circuit 124 may include any appropriate buffers, decoders, amplifiers and so forth.

The display 108 may be coupled to the control circuit 116 by a video processing circuit 130 that converts video data to a video signal used to drive the display 108. The video processing circuit 130 may include any appropriate buffers, decoders, video data processors and so forth. The video data may be generated by the control circuit 116, retrieved from a video file that is stored in the memory 110, derived from an incoming video data stream that is received by the radio circuit 122 or obtained by any other suitable method.

The mobile telephone 100 may further include one or more I/O interface(s) 132. The I/O interface(s) 132 may be in the form of typical mobile telephone I/O interfaces and may include one or more electrical connectors. As is typical, the I/O interface(s) 132 may be used to couple the mobile telephone 100 to a battery charger to charge a battery of a power supply unit (PSU) 134 within the mobile telephone 100. In addition, or in the alternative, the I/O interface(s) 132 may serve to connect the mobile telephone 100 to a personal computer 90, as discussed above. Further, the I/O interface(s) 132 may serve to connect the mobile telephone 100 to an accessory device, a personal computer, computer peripheral or any other electronic device via a data cable for the exchange of data (e.g., via the electrical connector 114) and/or through a wireless adapter (not shown) that may be connected to the electrical connector 114. Additionally, the mobile telephone 100 may receive operating power via the I/O interface(s) 132 when connected to a vehicle power adapter or an electricity outlet power adapter.

The mobile telephone 100 also may include a system clock 136 for clocking the various components of the mobile telephone 100, such as the control circuit 116. The control circuit 116 may, in turn, carry out timing functions, such as timing the durations of calls, generating the content of time and date stamps, and so forth.

Referring now to the exemplary personal computer 90, the personal computer 90 includes a primary control circuit 150 that is configured to carry out overall control of the functions and operations of the personal computer 90. The control circuit 150 may include a processing device 152, such as a CPU, microcontroller or microprocessor. The processing device 152 executes code stored in a memory (not shown) within the control circuit 150 and/or in a separate memory (not shown), in order to carry out operation of the personal computer 90. The memory may be, for example, a buffer, a flash memory, a hard drive, a removable media, a volatile memory and/or a non-volatile memory. In addition, the processing device 152 executes code to carry out various functions of the personal computer 90.

The personal computer 90 includes an input/output interface adapter 154, which is shown coupled to the data cable 102 at electrical connector 104. The other end of the cable 102 has a connector 106, which is coupled to the mobile telephone 100. The input/output interface adapter 154 generally serves to connect the personal computer 90 with the mobile telephone 100, as desired.

Figure 7A:
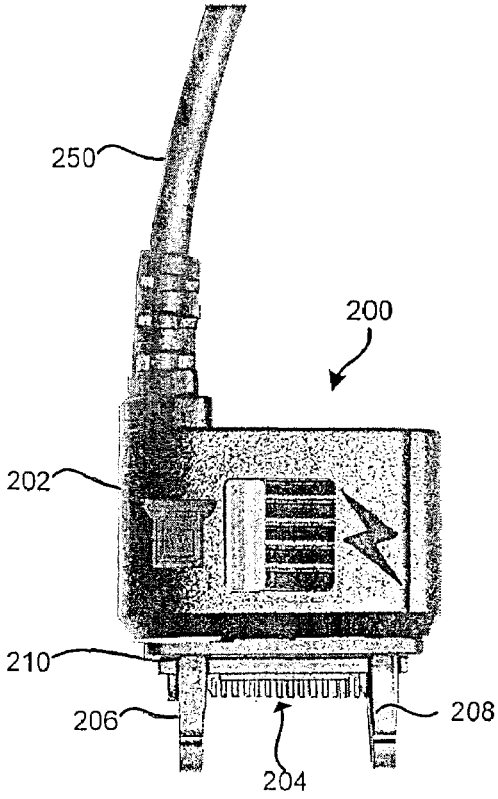
FIGS. 7A and 7B are exemplary embodiments of electrical connectors in accordance with aspects of the present invention.
Figure 7B:
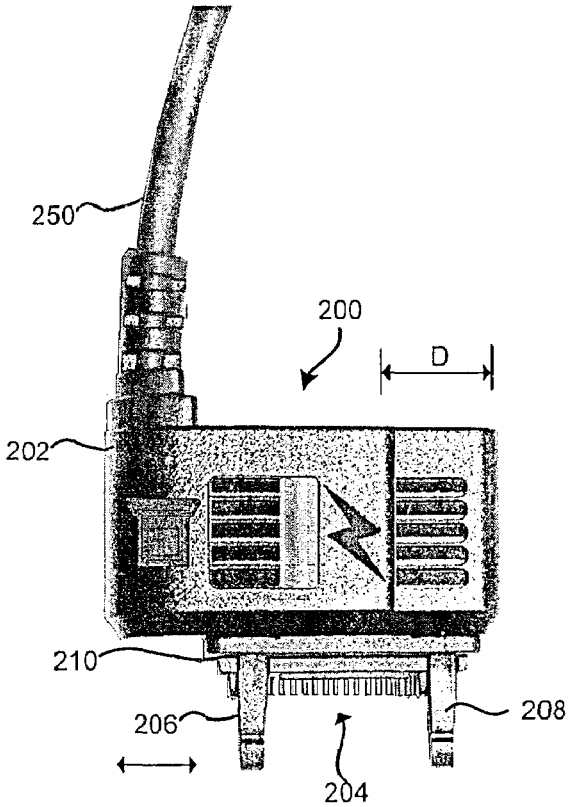

Referring to FIGS. 7A and 7B, an exemplary connector 200 in accordance with aspects of the present invention is illustrated. The exemplary connector is identical to the electrical connector 106 illustrated in FIGS. 5 and 6. The exemplary connector 200 includes an adjustable housing 202 operable in a first position (illustrated in FIG. 7A) and a second position (illustrated in FIG. 7B). The adjustable housing 202 at least partially houses a plurality of signal contacts 204 within the adjustable housing. A portion of one or more of the signal contacts may extend from the housing to engage an associated electronic device (e.g., a cradle, a desk stand, a mobile telephone, etc.).

Figure 8:
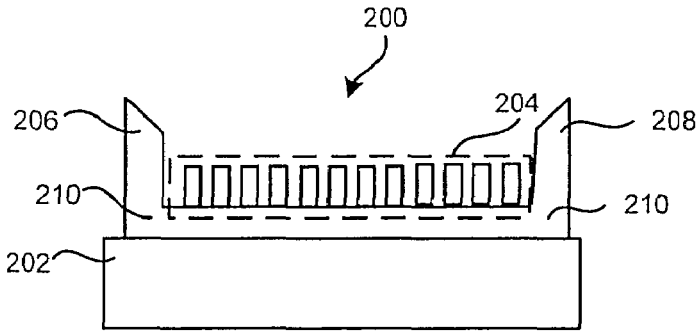
FIG. 8 is an exemplary connector in accordance with aspects of the present invention.

The plurality of signal contacts 204 may be of any desired configuration and/or value. For example, referring to FIG. 8, the plurality of signal contacts 204 may be configured in a predetermined configuration that is standard on many mobile telephone manufactured by Sony Ericsson Communications AB, which is the assignee of the present application. As shown in FIG. 8, the plurality of signal contacts 204 may be configured in a 12-pin configuration. Table 1 is an exemplary identification of signals for each of the respective 12-pins (moving from left to right on the system connector 200):

TABLE 1

| PIN | Signal |
|---|---|
| 1 | USB +5 V in |
| 2 | SP_REF |
| 3 | Mic+/AUXIN_L |
| 4 | Mic−/AUXIN_R |
| 5 | SP_L |
| 6 | SP_R |
| 7 | VIDEO/STB |
| 8 | VPPFLASH |
| 9 | GND |
| 10 | USB DATA+ |
| 11 | USB DATA− |
| 12 | Charge In |

One of ordinary skill in the art will readily appreciate that the pinout description set forth in Table 1 is exemplary in nature and any suitable pinout may be used in accordance with the present invention.

Referring to FIG. 7A, the connector 200 is illustrated in a first position. The plurality of contacts 204 extend outward from the adjustable housing 202 to electrically connect the connector 200 with the desired electronic device and/or mobile telephone 100. The contacts 204 are highly conductive, as is conventional.

Optionally, the connector 200 may include one or more engagement structures 206, 208 to mechanically secure the connector 200 to the desired electronic device and/or mobile telephone. Generally the engagement structures 206, 208 are inserted into a corresponding receiving port on the desired electronic device. When properly engaged, the engagement structures 206, 208 allow the plurality of contacts 204 to electronically engage with the electronic device. As shown in FIG. 7A, the engagement structures 206, 208 and the plurality of contacts 204 may be mounted on and/or form a support member 210.

In one embodiment, the engagement structure 208 may be fixedly secured to the housing 202 and functions to allow the user to configure the connector 200 in the first position and a second position. When the user slides the support member 210 from the first position to the second position, as illustrated in FIG. 7B, the support member 210 traverses across a portion of the adjustable housing 202, which causes the adjustable housing to expand. The adjustable housing 202 expands a distance "D" as illustrated in FIG. 7B. This distance may be any desired distance and may be used to support mechanical keying, as discussed below.

Referring to FIG. 7B, the connector 200 is illustrated in a second position. When the support member 210 is moved from the first position to the second position, the support member 210 is offset from the first position. The area of the connector 200, as measured around the periphery of the connector 200 is larger in the second position than when the connector was in the first position. As discussed above, since the engagement structure 208 may be formed in and/or secured to a side of the adjustable housing 202, the engagement structures 206, 208 and the plurality of contacts 204 are offset the distance D from their original position. One of ordinary skill in the art will readily appreciate that the distance D may be any desirable distance and is preferably a small distance (e.g., less than 1 centimeter).

The above mechanical solution allows a single cable to be configured in a first position to operate in first mode (e.g., USB data mode) and a second position to operate in a second mode (e.g., high current charging mode) and vice versa.

Figure 9A:
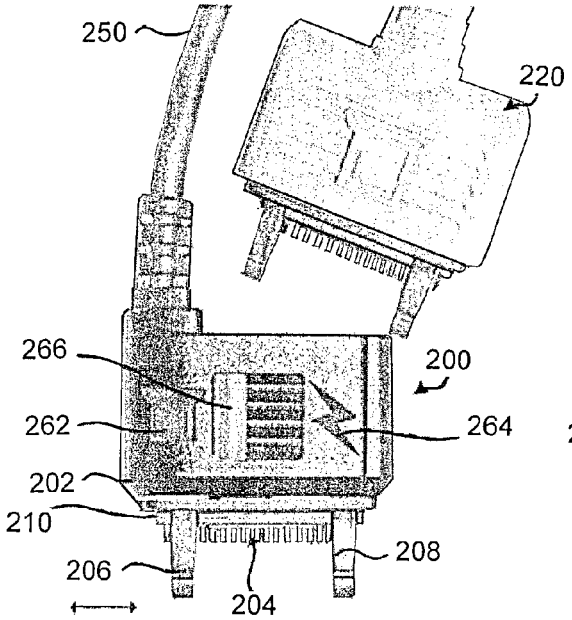
FIGS. 9A and 9B are exemplary embodiments of electrical connectors in accordance with aspects of the present invention.
Figure 9B:
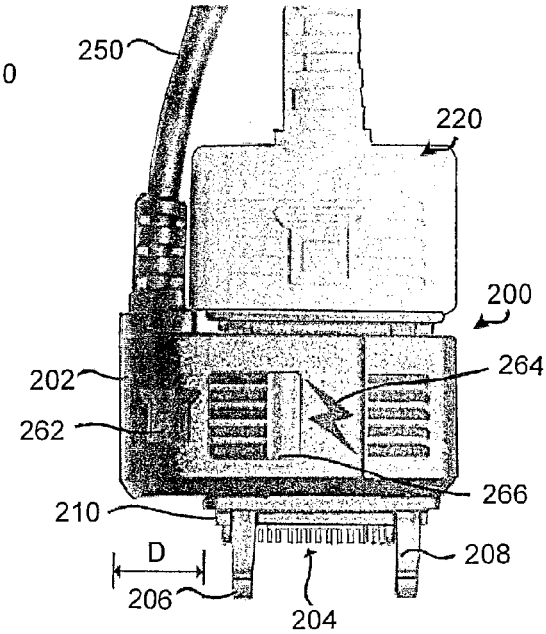

Referring to FIGS. 9A and 9B, the distance D may be chosen to allow mechanical keying. For example, it may be desirable to allow the adjustable housing 202 to receive another connector when the adjustable housing is in the second position, but not the first position. As shown in FIG. 9A, when the connector is in the first position, a second connector 220 may not be connected to the connector 200. However, when the connector 200 is in the second position, as shown in FIG. 9B, the second connector 220 may be connected to the connector 200. Such arrangement is desirable when, for example, it is desired to connect the connector 200 to a charger when the connector 200 is in a charger mode. However, such a connection may not be desirable when the connector is in the first mode (e.g., USB data mode), for example.

As shown in FIG. 9A, cable 250 is fixedly connected to the connector 200 and prevents the second connector 220 from being coupled to the connector 200 in the first position. In the second position, the adjustable housing 202 is offset a sufficient distance to allow the second connector 220 to be coupled to the connector 200. One of ordinary skill in the art will readily appreciate that other mechanical keying solutions may be used in accordance with the present invention. For example, instead of cable 250 being used to cooperate with the position of the connector 200, it may be desirable to incorporate one or more molded keying elements or securing one or more external keying elements on the connector 200 to allow and/or prevent attachment of a connector to another connector and/or to an electronic device. Thus, the adjustable housing 202 cooperates with another structure of the housing, the interconnecting connector (e.g., connector 220), cable 250, a housing of the electronic device and/or any other desirable structure to facilitate connections between various connectors, when desirable and prevent or prohibit connections when it is deemed undesirable to connect one or more predetermined connectors to the connector 200 and/or to the electronic device.

As shown in FIGS. 9A and 9B, the connector 200 may include one or more mode indicators 262, 264, 266 that indicate to the user the mode that the connector and/or cable is configured for based upon the position of the adjustable housing 202 and/or support member 210. The indicators may be formed in the adjustable housing, such as for example indicators 262 and 264, which are used to identify data mode and charger mode, respectively. In addition, indicator 266 may illuminate to indicate particular mode of operation. For example in data mode, the indicator 266 may illuminate in a first color (e.g., gold, yellow, etc.) and in data charging mode the indicator 266 may illuminate in another color (e.g., green, red, etc.). One of ordinary skill in the art will readily appreciate that a wide variety of indicators may be used to indicate to the user the particular mode in which the connector and/or cable is configured to operate.

Figure 10A:
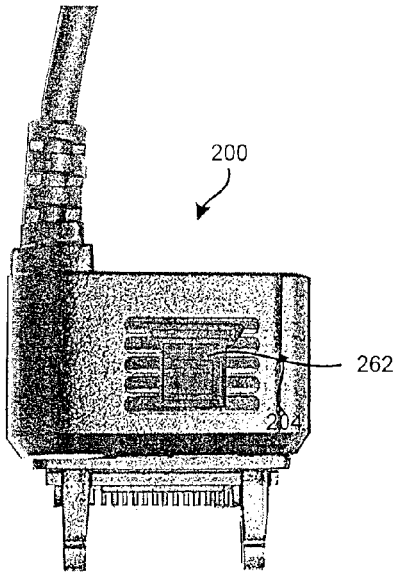
FIGS. 10A and 10B are exemplary embodiments of electrical connectors in accordance with aspects of the present invention.
Figure 10B:
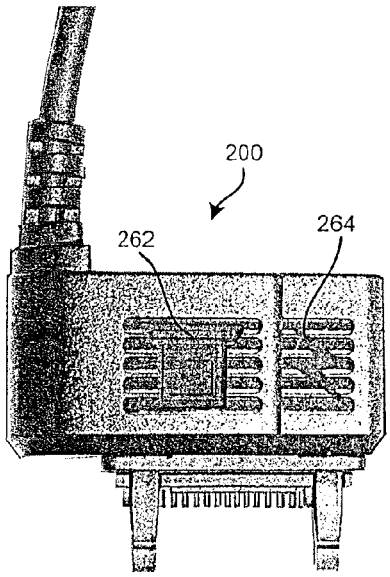

In one embodiment, the adjustable housing 202 includes an indicator for all of the modes of operation when the housing is in its most compact state (e.g., least amount of area), as shown in FIG. 9A. In another embodiment, when the adjustable housing 202 is in its most compact state, only the indicator for that state (e.g., indicator 262) is viewable by the user, as shown in FIG. 10A. When the user slidably adjusts the adjustable housing 202 to the second position, the indicator associated therewith is made available (viewable) to the user to indicate the operation mode of the connector 102 and/or cable (e.g., indicator 264, as shown in FIG. 10B). One of ordinary skill in the art will readily appreciate that the indicators may be placed in any desirable location on the connector 200 in order to enable and/or facilitate use by an associated user.

Figure 11:
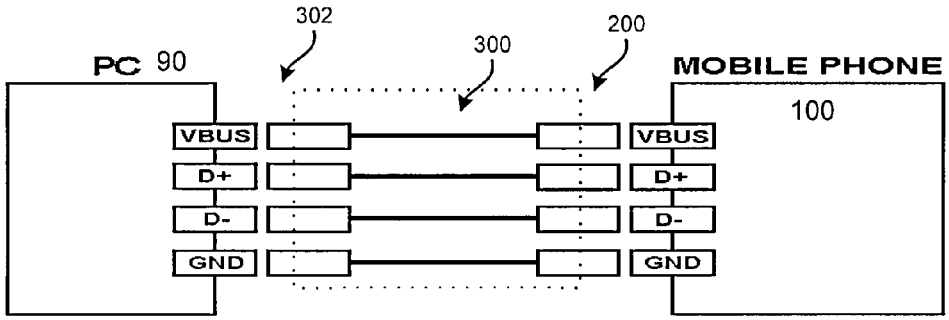
FIG. 11 is a circuit formed when the exemplary connector is in a first mechanical position between a personal computer and a mobile telephone.

Referring to FIG. 11, the connector 200 is illustrated in the first position, wherein the connector 200 configures the circuitry housed within the adjustable housing 202 to function as a conventional USB cable. The connector 200 is generally coupled through a cable 300 to a second connector 302. The second connector 302 is typically a Type-A USB connector. One of ordinary skill in the art will readily appreciate that the connector 302 may be any desired connector (e.g., conventional USB, mini-USB, micro-USB, RS-232, digital connector, etc.) As shown in FIG. 11, the second connector 302 includes conventional USB signals, such as, VBUS, D+, D−, and GND. The cable 300 is generally configured to include independent signal paths for each of the USB signals along the length of the cable and such signals are generally available at one or more signal contacts associated with the connectors 200, 302 along the length of the cable. In operation, the cable 300 may be coupled to a conventional USB port of a personal computer, as discussed above. The connector 200 may be coupled to the mobile telephone 100 and/or desk stand, which in turn is coupled to the mobile telephone.

As set forth above, with the connector 302 coupled to the personal computer, the connector 200 is coupled to the mobile telephone 100 (either directly or through the desk stand). When the adjustable housing 202 of the connector 200 is in the first position, the connector 200 is suitable for operation in a first mode. For example, in the first mode, the cable 300 may function as a standard USB cable. In such case, the corresponding VBUS, D+, D−, and GND signals output by the computer are received by the mobile telephone for use in a conventional manner. Such uses include, for example, exchanging data between the mobile telephone and the personal computer and to charge the mobile telephone 100 from the personal computer 90. Due to limited amount of current that may be output a USB port (e.g., 500 mA), it generally takes a substantial amount of time to fully charge a mobile telephone in this mode. In the first position, it is generally undesirable to allowing stacking a USB connector into the connector 200, as shown in FIG. 9A.

Figure 12:
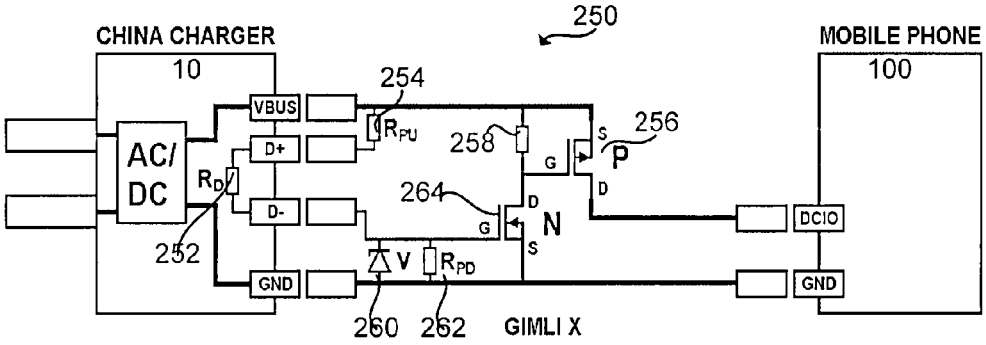
FIG. 12 is a circuit formed when the exemplary connector is in a second mechanical position between a China Charger and a mobile telephone.

Referring to FIG. 12, when the adjustable housing 202 of the connector 200 is in the second position, the connector 200 is configured to a charging mode for fast charging the mobile telephone 100. In the fast charging mode, current is generally provided from the computer at a higher flow rate than the current provided in the data mode, which enables faster charging of the mobile telephone 100. As illustrated in FIG. 12, the behavior of the cable, due to the configuration of connector 200 is an updated Gimli (referred to as a Gimli X). The Gimli X uses the short circuit in the China Charger for sense only. Accordingly, the cable 300 drives no high current through D+ or D− in the China Charger mode and allows the Gimli X to work even if there is a resistance (e.g., of 200 ohm) between D+ and D−, as illustrated in FIG. 12. In the second position, it may be desirable to allowing stacking of a USB connector into the connector 200 in order to facilitate an exchange of data to occur, while in the fast charging mode, as shown in FIG. 9B.

Referring to FIG. 12, a charging circuit 250 is illustrated with the adjustable housing 202 of the connector in a second mechanical and/or electrical position. As illustrated, a China Charger 10 is connected to the connector. In operation, the N-Type transistor 264 is electrically pulled up to the VBUS signal through resistance 254 and 252. As one of ordinary skill in the art will readily appreciate the sum of resistance associated with resistors 254 and 252 are much less than the resistance associated with the pull down resistor 262. In operation, the N-type transistor 264 opens and the gate of P-type transistor 256 is tied to GND. With the gate of the P-type transistor 256 pulled to GND, current flows from source to drain of the transistor and hence that VBUS is connected to DCIO. The resistor 258 works as a pull up resistor to keep the P-type transistor 256 closed as long no low resistance is connected between the D+ and D− signals. Diode 260 provides for electrostatic discharge (ESD) protection for the gate of the N-Type Transistor 264.

Figure 13:
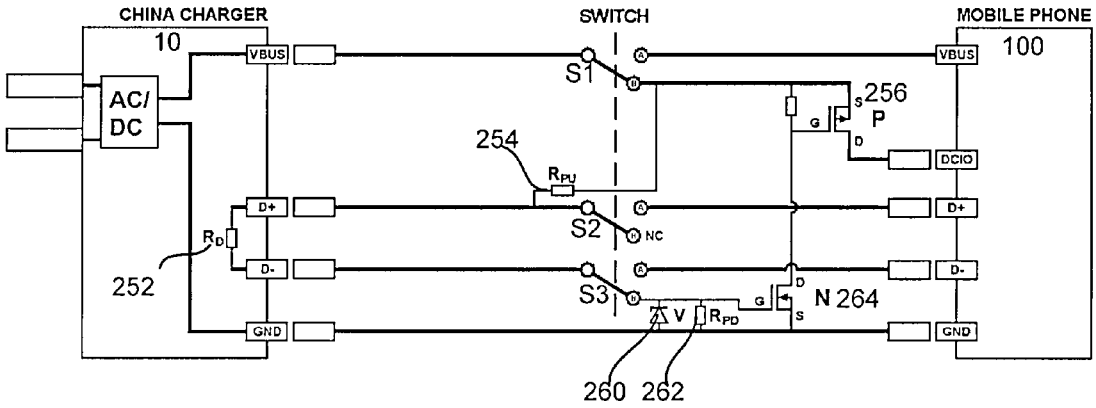
FIGS. 13 and 14 are exemplary embodiments of dual mode circuits in accordance with aspects of the present invention.
Figure 14:
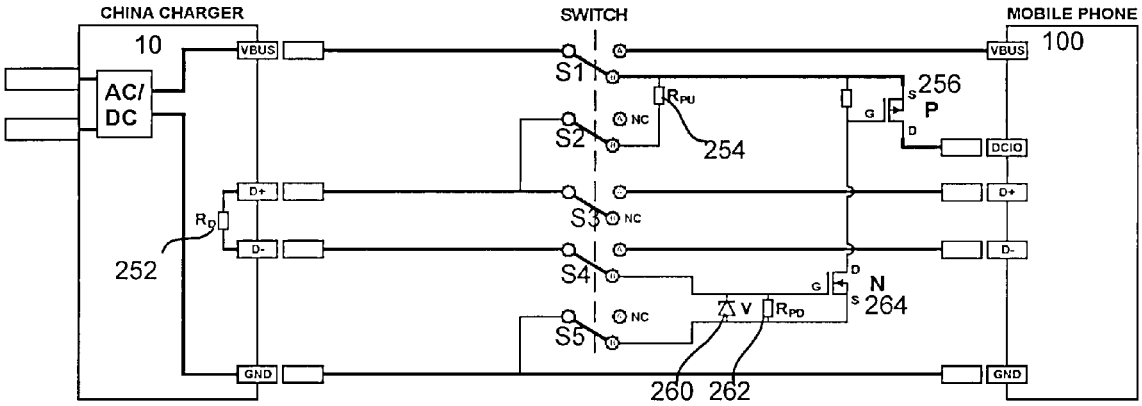

Referring to FIG. 13, a dual mode circuit diagram for the complete universal cable is shown. In the figure, the user is using a China Charger and has therefore switched the connector 200 to the charging mode (e.g., switch position B). For example, the switches S1-S3 are electrically coupled to a second mode of operation associate with the China Charger. In position B, the resulting circuit operates as described above with respect to FIG. 12. When the user switches the connector 200 to position A, the switch signals S1-S3 switch states from position B to position A, which results in the cable functioning as a conventional USB cable, as explained above with respect to FIG. 11, Since there might be a problem with high stray capacitances with the cable in USB data mode (switch in position A) on data lines with the electrical solution according to FIG. 13, especially stray capacitance on the D− signal from electrostatic discharge (ESD) protection diode 260 and the gate of the transistor 262. An alternative electrical solution is illustrated in FIG. 14. In FIG. 14, the switch S2 and S5 disconnect charging components (e.g., transistor 264, resistor 262, and diode 260) in USB data mode (e.g., when the switches S1-S5 are switched to position A.

Specific embodiments of the invention have been disclosed herein. One of ordinary skill in the art will readily recognize that the invention may have other applications in other environments. In fact, many embodiments and implementations are possible. The following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A universal system connector cable comprising:

a first connector having a plurality of first signal contacts housed at least partially therein;

a second connector including: an adjustable housing operable in a first position and a second position, wherein the adjustable housing is slidably configured between the first position and the second position;

a plurality of second signal contacts housed at least partially within the adjustable housing; and circuitry housed within the adjustable housing, wherein when the housing is in the first position, the plurality of second signal contacts are configured to operate in a first mode and when the adjustable housing is in the second position, the plurality of second signal contacts are configured to operate in a second mode, wherein the second mode includes charging an associated electronic device coupled to the second connector at a faster rate than the first mode; and a cable connected to the first connector and the second connector.

2. The universal system connector cable of claim 1, wherein the first connector is a universal serial bus (USB) connector.

3. The universal system connector cable of claim 2, wherein the plurality of first contacts include a contact for a data + signal contact, a data − signal contact, a ground signal contact and VBUS signal contact.

4. The universal system connector cable of claim 3, wherein when the adjustable housing is in the first position, the plurality of second signal contacts are configured to output corresponding data + signal contact, the data − signal contact, the ground signal contact and the VBUS signal contact.

5. The universal system connector cable of claim 4, wherein when the adjustable housing is in the first position, the first contacts and the second contacts are configured to exchange information between associated electronic devices coupled to the cable in the first mode.

6. The universal system connector cable of claim 5, wherein the first mode includes charging the electronic device coupled to the second connector from a power source associated with the electronic device coupled to the first connector.

7. The universal system connector cable of claim 1, wherein when the adjustable housing is in the second position, the plurality of second signal contacts are configured to output the ground signal and a high current signal to an associated electronic device coupled to the second connector for operation in the second mode.

8. The universal system connector cable of claim 7, wherein the cable is coupled to the second connector on a face opposing a surface of the second connector that engages the associated electronic device.

9. The universal system connector cable of claim 8, wherein the cable cooperates with the adjustable housing to prevent stacking of one or more connectors to the adjustable housing when the adjustable housing is in the first position.

10. The universal system connector cable of claim 8, wherein the cable cooperates in conjunction with the adjustable housing to allow stacking of a non-charger connector to the adjustable housing when the adjustable housing is in the second position.

11. The universal system connector cable of claim 1, wherein the circuitry includes a P-type field effect transistor and a N-type field effect transistor, wherein in the second position, the P-type field effect transistor is operative to provide a fast charging current to the associated electronic device.

12. The universal system connector cable of claim 11, wherein the D+ and D− signal contacts are electrically pulled up to the VBUS signal when the adjustable housing is in the second position and a China Charger is attached.

13. The universal system connector cable of claim 11, wherein in the first position, the P-type field effect transistor and the N-type field effect transistor are in an off state.

14. A universal system connector comprising:

an adjustable housing operable in a first position and a second position, wherein the adjustable housing is slidably configured between the first position and the second position;

at least one engagement structure coupled to the housing for securing the housing to an associated electronic device;

a plurality of signal contacts housed at least partially within the adjustable housing;

circuitry housed within the adjustable housing, wherein when the housing is in the first position, the plurality of signal contacts are configured to operate in a first mode and when the adjustable housing is in the second position, the plurality of signal contacts are configured to operate in a second mode, wherein the second mode includes charging an associated electronic device coupled to the second connector at a faster rate than the first mode.

15. The universal system connector of claim 14, wherein the adjustable housing has a larger area in the second position than in the first position.

16. The universal system connector of claim 14 further including a cable secured to the universal system connector on a face opposing a signal contact interface.

17. A cable keying system, the system comprising:

a cable having a first connector for coupling to a first electronic equipment and a second connector for coupling to a second electronic equipment to facilitate an exchange of signals between the first electronic equipment and the second electronic equipment, wherein the first connector has an adjustable housing that is operable in a first position to perform a first electronic function and the first connector is operable in a second position to perform a second electronic function, wherein the adjustable housing is slidably configured between the first position and the second position and the position of the connector allows one or more connectors to be coupled to the first connector and prevents at least one predetermined other cable from coupling to the first connector based at least in part on the position of the connector and wherein the second electronic function and the first electronic functions include charging the first electronic equipment coupled to the first connector at different rates.

* * * * *